United States Patent [19]

Vatsky et al.

[11] Patent Number: 4,471,703

[45] Date of Patent: Sep. 18, 1984

[54] COMBUSTION SYSTEM AND METHOD FOR A COAL-FIRED FURNACE UTILIZING A LOUVERED LOW LOAD SEPARATOR-NOZZLE ASSEMBLY AND A SEPARATE HIGH LOAD NOZZLE

[75] Inventors: Joel Vatsky, Millburn; Edmund S. Schindler, Maplewood, both of N.J.

[73] Assignee: Foster Wheeler Energy Corporation, Livingston, N.J.

[21] Appl. No.: 530,446

[22] Filed: Sep. 8, 1983

[51] Int. Cl.[3] ..... F23K 1/00

[52] U.S. Cl. ..... 110/263; 110/264; 110/106; 55/442

[58] Field of Search ..... 110/261–265, 110/106 R, 347; 55/442, 444

[56] References Cited

U.S. PATENT DOCUMENTS

| | | | |
|---|---|---|---|
| 408,285 | 8/1889 | Boehning | 55/442 |
| 2,506,273 | 5/1950 | Linderoth | 55/444 |
| 2,876,862 | 3/1959 | Hummel | 55/444 |
| 3,155,474 | 11/1964 | Sexton | 55/442 |
| 3,757,892 | 9/1973 | Randman, Jr. | 55/442 |
| 3,958,966 | 5/1976 | Keller | 55/442 |
| 4,123,241 | 10/1978 | Maden | 55/442 |
| 4,147,116 | 4/1979 | Graybill | 110/264 |
| 4,241,673 | 12/1980 | Smith et al. | 110/264 |
| 4,249,470 | 2/1981 | Vatsky | 110/264 |
| 4,274,343 | 6/1981 | Kokkinos | 110/347 |

*Primary Examiner*—Henry C. Yuen

*Attorney, Agent, or Firm*—Marvin A. Naigur; John E. Wilson; Warren B. Kice

[57] ABSTRACT

A combustion system and method for a coal-fired furnace in which a separator-nozzle assembly divides a coal-air mixture into a first stream containing most of the coal and a second stream containing a much smaller quantity of coal. Another nozzle is provided which receives another mixture of coal and air and discharges same in a combustion supporting relation to said streams. At start up and low loads, the separator-nozzle assembly discharges a majority of the coal and air in a combustion supporting relationship and the other nozzle discharges a relatively low quantity of coal and air. At high load conditions, the other nozzle discharges a majority of the coal and air while the coal and air discharging from the separator-nozzle assembly is kept at relatively low values. A splitter is provided for receiving a coal-air mixture from a mill and splitting it into two separate mixtures.

12 Claims, 5 Drawing Figures

COMBUSTION SYSTEM AND METHOD FOR A COAL-FIRED FURNACE UTILIZING A LOUVERED LOW LOAD SEPARATOR-NOZZLE ASSEMBLY AND A SEPARATE HIGH LOAD NOZZLE

BACKGROUND OF THE INVENTION

This invention relates to a combustion system and method for a coal-fired furnace and, more particularly, to such a system and method which utilizes coal as the primary fuel and combusts a coal-air mixture.

In a typical coal-fired furnace, particulate coal is delivered in suspension with primary air from a pulverizer, or mill, to the coal burners, or nozzles, and secondary air is provided to supply a sufficient amount of air to support combustion. After initial ignition, the coal continues to burn due to local recirculation of the gases and flame from the combustion process.

In these types of arrangements, the coal readily burns after the furnace has been operating over a fairly long period of time. However, for providing ignition flame during startup and for warming up the furnace walls, the convection surfaces and the air preheater; the mixture of primary air and coal from conventional main nozzles is usually too lean and is not conducive to burning under these relatively cold circumstances. Therefore, it has been the common practice to provide oil or gas fired ignitors and/or guns for warming up the furnace walls, convection surfaces and the air preheater, since these fuels have the advantage of a greater ease of ignition and, therefore, require less heat to initiate combustion. The ignitors are usually started by an electrical sparking device or swab, and the guns are usually lit by an ignitor or by a high energy or high tension electrical device.

Another application of auxiliary fuels to a coal-fired furnace is during reduced load conditions when the coal supply, and, therefore, the stability of the coal flame, is decreased. Under these conditions, the oil or gas ignitors and/or guns are used to maintain flame stability in the furnace and thus avoid accumulation of unburned coal dust in the furnace.

However, in recent times, the foregoing advantages of oil or gas fired warmup and low load guns have been negated by increasing costs and decreasing availability of these fuels. This situation is compounded by the ever-increasing change in operation of coal-fired nozzles from the traditional base-loaded mode to that of cycling, of shifting, modes which place even more heavy demands on supplemental oil and gas systems to support these types of units.

To alleviate these problems, it has been suggested to form a dense phase particulate coal by separating air from the normal mixture of pulverized coal and air from the mill and then introducing the air into a combustion supporting relation with the resulting dense phase particulate coal as it discharges from its nozzle. However, this requires very complex and expensive equipment externally of the nozzle to separate the coal and transport it in a dense phase to the nozzle.

SUMMARY OF THE INVENTION

It is, therefore, an object of the present invention to provide a combustion system and method for a coal-fired furnace which will substantially reduce or eliminate the need for supplementary fuel, such as oil or gas, to achieve warmup, startup and low load stabilization.

It is a further object of the present invention to provide a system and method of the above type in which a first nozzle assembly is provided which produces a dense phase particulate coal for use during startup, warmup and low load conditions, and a second nozzle is provided for use during high load conditions.

It is a still further object of the present invention to provide a system and method of the above type in which a dense phase particulate coal is formed in the first nozzle assembly and air is introduced in a combustion supporting relation with the dense phase particulate coal without the need for complex and expensive external equipment.

It is a still further object of the present invention to provide a system and method of the above type in which the first nozzle assembly receives a mixture of coal and air, separates the coal from the air, and discharges both in a combustion-supporting relationship.

Toward the fulfillment of these and other objects, the system and method of the present invention includes a separator-nozzle assembly for receiving a coal-air mixture and for forming a first stream containing most of the coal and a second mixture containing a much smaller quantity of coal. Another nozzle receives another mixture of coal and air and discharges same in a combustion supporting relationship with the first and second streams. A splitter receives a coal-air mixture from a mill and splits it into two separate mixtures and is adapted to vary the quantities introduced to the separator-nozzle and to the other nozzle so that, at start-up and low load conditions, a relatively large quantity of the mixture is introduced to the separator-nozzle while, at high load conditions, a relatively large quantity of the mixture is introduced to the other nozzle.

BRIEF DESCRIPTION OF THE DRAWINGS

The above brief description, as well as further objects, features and advantages of the present invention will be more fully appreciated by reference to the following detailed description of a presently preferred but, nonetheless, illustrative embodiment in accordance with the present invention, when taken in conjunction with the accompanying drawings wherein.

DESCRIPTION OF THE PREFERRED EMBODIMENT

Figure 1:
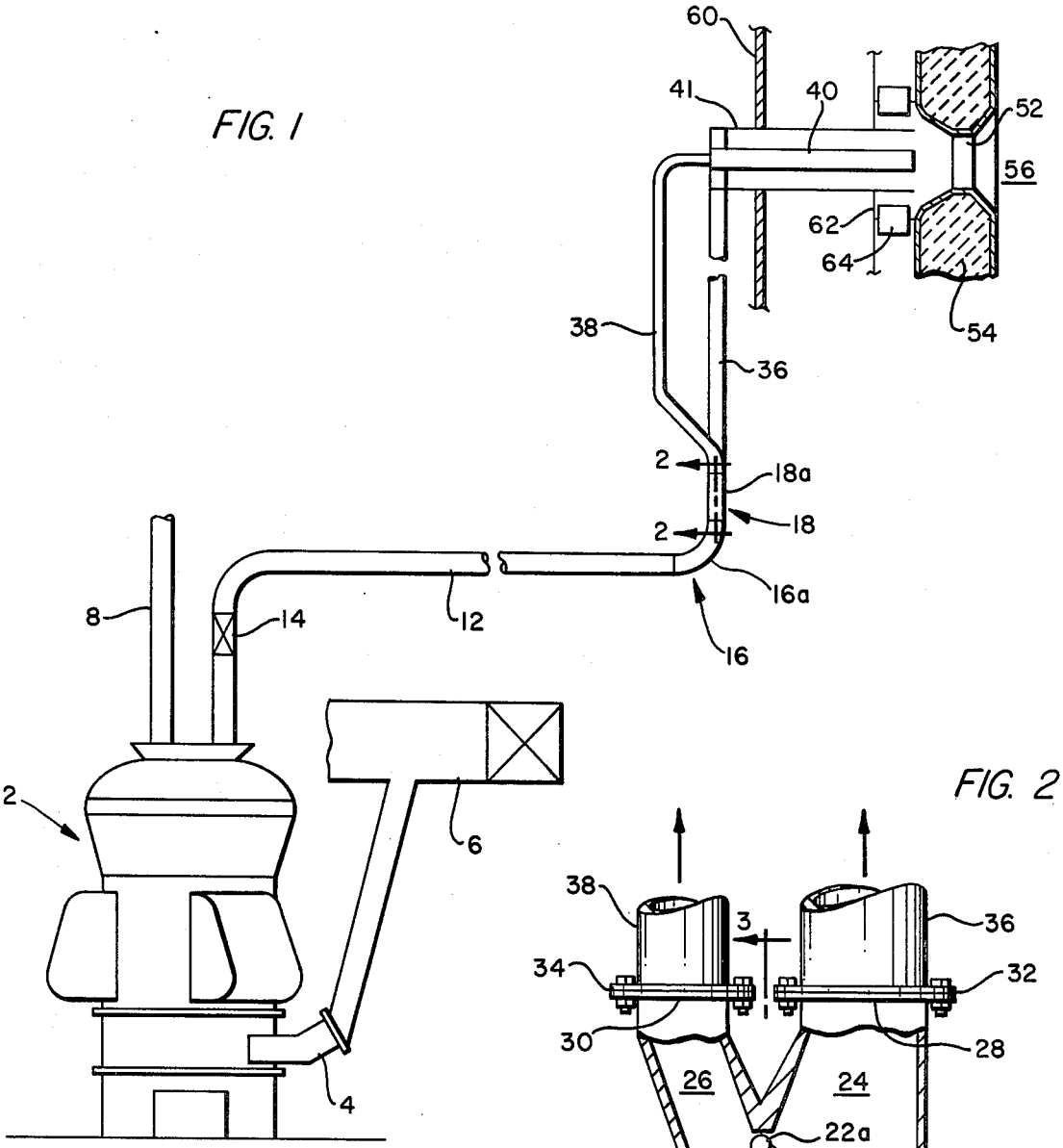
FIG. 1 is a schematic diagram depicting the combustion system of the present invention.

Referring specifically to FIG. 1 of the drawings, the reference numeral 2 refers in general to a mill, or pulverizer, which has an inlet 4 for receiving air from a primary air duct 6, it being understood that the latter duct is connected to an external source of air and that a heater, or the like can be provided in the duct for preheating the air. The mill has an inlet 8 for receiving raw coal from an external source, it being understood that both the air and coal are introduced into the mill under the control of a load control system, not shown.

The mill 2 operates in a conventional manner to dry and grind the coal into relatively fine particles, and has an outlet located in its upper portion which is connected to one end of a conduit 12 for receiving the mixture of pulverized coal and air. A shutoff valve 14 is provided in the conduit 12 and controls the flow of the coal/air mixture to an elbow 16 connected to the other end of the conduit and to a splitter 18 connected to the elbow. The elbow 16 has a rectangular cross-section and the coal is caused to move towards the outer portion 16*a* (or right side as viewed in FIG. 1) of the turn of the elbow by centrifugal forces. Therefore, as the stream enters the splitter 18, the coal is essentially concentrated and spreads out on its surface 18*a* for reason described later. It is understood that, although only one conduit 12 is shown in detail in the interest of clarity, the mill 2 will have several outlets which connect to several conduits identical to conduit 12, which, in turn, are connected to several elbows 16 and splitters 18, with the number of outlets, conduits, elbows and splitters corresponding in number to the number of burners, or nozzles, utilized in the particular furnace.

Figure 2:
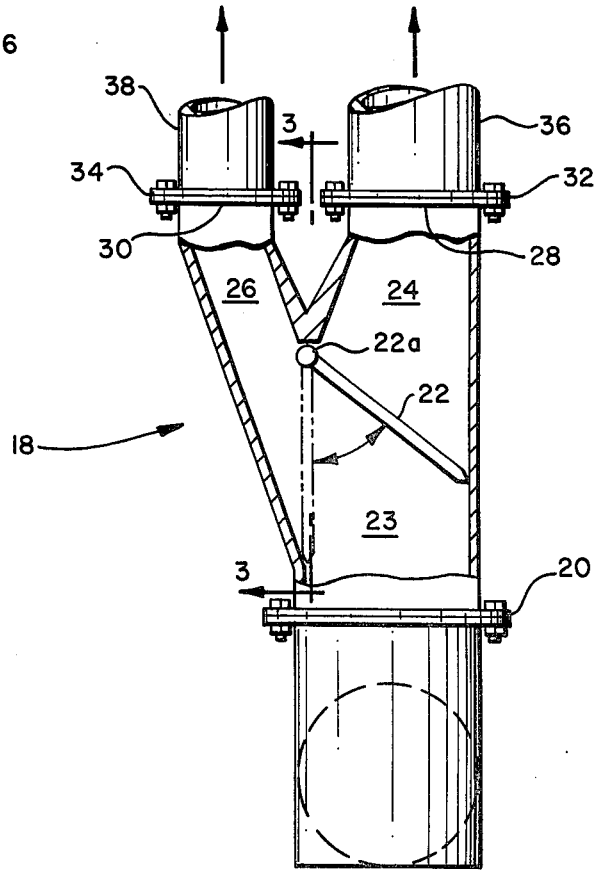
FIGS. 2 and 3 are enlarged cross-sectional views taken along the lines 2—2 and 3—3 of FIGS. 1 and 2 respectively.
Figure 3:
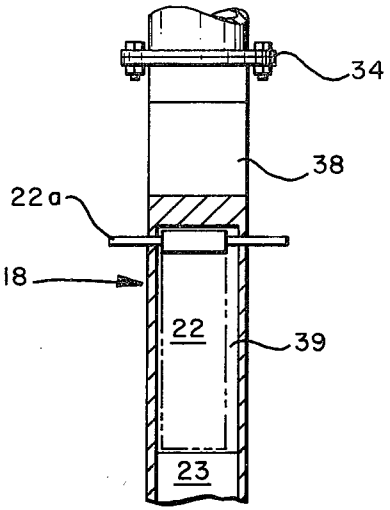

The splitter 18 is shown in detail in FIGS. 2 and 3 and includes a connecting flange 20 which connects to the end portion of the elbow 16. A damper 22 is provided in the interior of the splitter 18 and divides the main splitter chamber 23 into a chamber 24 extending in line with the end poriton of the elbow 16, and a chamber 26 extending immediately adjacent to the chamber 24. The splitter 18 includes two outlets 28 and 30 which register with the chambers 24 and 26, and which are provided with connecting flanges 32 and 34, to connect them to two conduits 36 and 38, respectively. The damper 22 is pivotal about a shaft 22*a* under the control of a control system (not shown) to vary the proportional flow rate between the chambers 24 and 26 and, therefore, the output to the conduits 36 and 38.

When the damper 22 is in the positon shown by the solid lines in FIG. 2, most of the flow from the chamber 23 will be diverted into the chamber 26; and when the damper 22 is in the position as shown by the dashed lines, most of the flow from the chamber 23 will be directed into the chamber 24. Depending on the distance of the free end of the damper 22 to the side walls of the splitter 28, the quantity of flow to each of the chambers 24 and 26 can be controlled as required by the control system operating the shaft 22*a*.

The damper 22 is also designed and sized so that a gap 39 is formed between an edge portion of the damper and the corresponding wall of the splitter, as shown in FIG. 3. This gap permits some flow from the chamber 23 into the chamber 24 when the damper is in the solid-line position and also permits some flow from the chamber 23 into the chamber 26 when the damper is in the dashed-line position. The combined effect of the rotation of the damper 22 and the presence of the gap 39 results in a division of the total air and coal flow into each of the chambers 24 and 26 at all loads in a proportion that produces the desired operational characteristics that will be described in detail later.

Figure 4:
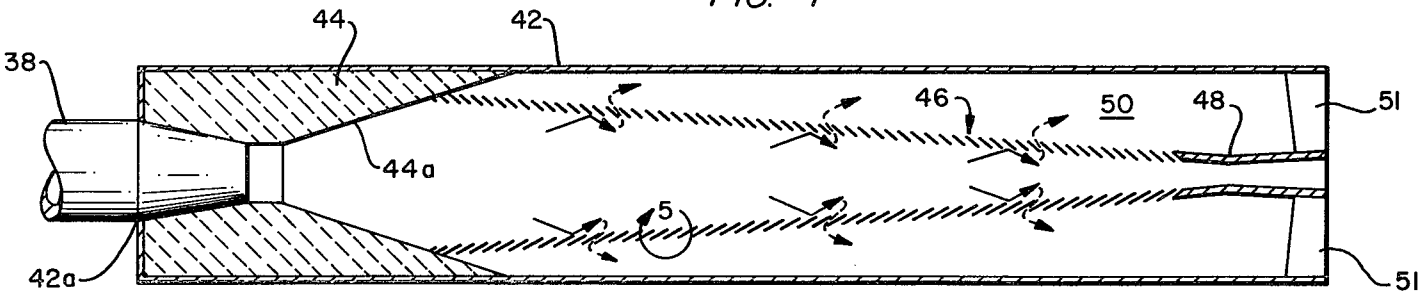
FIG. 4 is an enlarged cross-sectional view of a separator-burner assembly utilized in the system of FIG. 1.

Referring again to FIG. 1, the conduit 38 is connected to a separator-nozzle assembly, shown in general by the reference numeral 40, and the conduit 36 is connected to a conically shaped nozzle 41 extending around the assembly 40 in a coaxially spaced relationship. The separator-nozzle assembly 40 is better shown in FIG. 4 and includes an elongated housing 42 having an inlet 42*a* for receiving the conduit 38. A plug member 44 is disposed in the inlet end portion of the housing 42 and has a convergent-divergent bore, or venturi, 44*a* communicating with the opening 42*a* and, therefore, the conduit 38. A louvered cone 46 extends for substantially the entire length of the housing 42 and has one end portion extending within the bore 44*a*. A relatively short discharge venturi 48 extends from the other end of the cone 46 and flush with the other end of the housing 42. An annular chamber 50 is defined between the cone 46 and the housing 42 and a plurality of swirler blades 51 are disposed at the discharge end of the chamber 50, for reason to be explained later.

Referring again to FIG. 1, the separator-nozzle assembly 40 and the nozzle 41 are disposed in axial alignment with a through opening 52 formed in a front wall 54 of a conventional furnace forming, for example, a portion of a steam generator. Although not shown in the drawing, it is understood that the furnace includes a back wall and a side wall of an appropriate configuration to define a combustion chamber 56 immediately adjacent the opening 52. The front wall 54, as well as the other walls of the furnace include an appropriate thermal insulation material and, while not specifically shown, it is understood that the combustion chamber 56 can also be lined with boiler tubes through which a heat exchange fluid, such as water, is circulated in a conventional manner for the purposes of producing steam.

A vertical wall 60 is disposed in a parallel relationship with the furnace wall 54, and has an opening formed therein for receiving the separator-nozzle assembly 40 and the nozzle 41. It is understood that top, bottom, and side walls (not shown) are also provided which, together with the wall 60, form a plenum chamber or wind box, for receiving combustion supporting air, commonly referred to as "secondary air", in a conventional manner.

An annular plate 62 extends around the nozzle 41 and between the front wall 54 and the wall 60, and a plurality of register vanes 64 are pivotally mounted between the front wall 54 and the plate 62 to control the swirl of secondary air passing from the wind box to the opening 52. It is understood that, although only two register vanes 64 are shown in FIG. 1, several more vanes extend in a circumferentially spaced relation to the vanes shown. Also, the pivotal mounting of the vanes 64 may be done in any conventional manner, such as by mounting the vanes on shafts (shown schematically) and journalling the shafts in proper bearings formed in the front wall 54 and the plates 62. Also, the position of the vanes 64 may be adjustable by means of cranks or the like. Since these types of components are conventional, they are not shown in the drawings nor will be described in any further detail.

It is noted that the connection between the conduit 36 and the nozzle 41 is in a tangential direction so that a swirl is imparted to the coal/air mixture as it passes through the annular passage between the inner wall of the nozzle 41 and the housing 42 of the separator-nozzle assembly 40, before the mixture discharges towards the opening 52.

Although not shown in the drawings for the convenience of presentation, it is understood that various devices can be provided to produce ingnition energy for a short period of time to the dense phase coal particles discharging from the separator-nozzle assembly 40 to ignite the particles. For example, a high energy sparking device in the form of an arc ignitor or a small oil or gas conventional gun ignitor can be supported by the separator-nozzle assembly 40.

Assuming the furnace discussed above forms a portion of a vapor generator and it is desired to start up the generator, air is introduced into the inlet 4, and a relatively small amount of coal is introduced to the inlet 8, of the mill 2 which operates to crush the coal into a predetermined fineness. A relatively lean mixture of air and finely pulverized coal, in a predetermined proportion, is discharged from the mill 2 where it passes into and through the conduit 12 and the valve 14, and through the elbow 16 into the chamber 23 of the splitter 18. Since, in its passage through the elbow 16, the coal tends to move to the outer section (or right portion as viewed in FIG. 1) of the elbow as discussed above, a large portion of the mixture of coal and air entering this poriton is coal, while a large portion of the mixture entering the left section is air.

With the splitter damper 22 in the position shown by the solid lines in FIG. 2, the majority of the mixture of coal and air passing from the elbow and through the chamber 23 is directed into the chamber 26 and into the conduit 38 where it passes to the separator-nozzle assembly 40.

Of the remaining portion of the coal-air mixture in the chamber 23, the coal is concentrated in the left portion thereof, as viewed in FIG. 3, and the air is in the right portion. As a result, a relatively high quantity of air and a relatively low quantity of coal from the chamber 23 passes through the gap 39 and into the chamber 24 by the static pressure caused by the resistance imposed by the sizing of the components downstream of the separator. The relatively low amount of air and coal carried into the chamber 24 in this manner will flow into and through the conduit 36 and to the nozzle 41.

Figure 5:
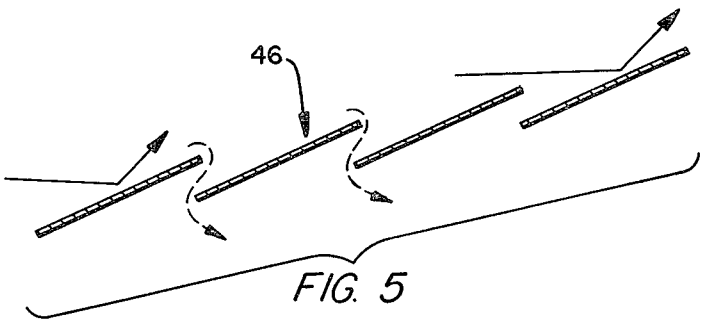
FIG. 5 is an enlarged view of circle 5 of FIG. 4.

The coal-air mixture passing from the conduit 38 into the separator-nozzle assembly 40 passes through the convergent-divergent bore, or venturi, 44*a* (FIG. 4) in the plug member 44 which causes the coal portion of the mixture to tend to take a central path through the cone 46 and the air to tend to pass through the cone in a path surrounding the coal and nearer the louvered wall portion of the cone. The louvered design of the cone 46 sets up aerodynamic forces which allow the faster rushing air to escape through the spaces between the louvers while the more sluggish coal particles are trapped along each louver and are ultimately drawn towards the discharge end of the core and into the tube 48. As a result, during its passage through the cone 46, that portion of the coal passing near the louvered portion of the cone takes the path shown by the solid flow arrows in FIG. 5, i.e. it tends to pass off of the louvers and back towards the central portion of the cone; while the air tends to pass through the spaces between the louvers and into the annular chamber 50 between the cone 46 and the housing 42, as shown by the dashed arrows. As a result, a stream of dense phase particulate coal, having a high coal-to-air ratio, discharges from the discharge venturi 48 of the cone 46 and a stream of air discharges from the chamber 50 and is swirled by the swirler blades 51. The coal and air thus intermix and recirculate in front of the discharge venturi 48 as a result of the swirl imparted to the air by the swirler blades 51 and the resulting reverse flow effect of the vortex formed. This results in a rich mixture which can readily be ignited by one of the techniques previously described, such as, for example, directly from a high energy spark, or an oil or gas ignitor. Although the coal output from the mill 2 is low, the concentration of the coal results in a rich mixture which is desirable and necessary at the point of ignition. The vortex so formed by this arrangement produces the desired recirculation of the products of combustion of the burning coal to provide heat energy to ignite the new coal as it enters the ignition zone. The vanes 64 can be adjusted as needed to provide secondary air to the combustion process to aid in flame stability.

The load can then be increased by placing more nozzles into service on the same mill or by placing more mills into service in a similar fashion. When the desired number of mills and nozzles are in service and it is desired to further increase the load, the coal flow is increased to each mill. At the same time, the splitter damper 22 associated with each mill 20 is rotated towards the chamber 26 to cause some of the particulate coal which has concentrated in the left portion of the splitter 18, as viewed in FIG. 3, along with a quantity of primary air, to be directed into the chamber 24 for passage, via the conduit 36, directly to the nozzle 41.

As the coal rate increases to full capacity, the splitter damper 22 continuous to be rotated towards the chamber 26 until it reaches the position shown approximately by the dashed lines in FIG. 2. In this position, a maximum flow of the coal/air mixture into the chamber 24, and therefore to the nozzle 41, is achieved, while some of the mixture passes through the gap 39 and past the splitter damper 22, through the chamber 26 and into the separator-nozzle assembly 40. By characterizing the motion of the splitter damper 22 with the mill output loading, the amount of coal and combustion supporting air going to the separator-nozzle assembly 40 can be kept at a low heat input value (approximately 5 to 20 percent of full load) while the nozzle 41 will increase (or decrease) in loading as required. Sufficient turbulence is maintained by the separator-nozzle assembly 40, and as load is increased, the effect of the main registers and secondary air flow patterns will further aid in overall burner stability.

Several advantages result from the foregoing. For example, during startup the energy expenditures from an ignitor occurs only for the very short time needed to directly ignite the dense phase particulate coal from the separator-nozzle assembly 40, after which startup and warmup are completed solely by the combustion of the dense phase particulate coal as assisted by the swirling air from the chamber 50 and the nozzle 41. Also, the dense phase particulate coal stabilizes the main coal flame at wide load range conditions providing more flexibility of operation and less manipulation of auxiliary fuels. Further, at low load conditions, the gap 39 provides a means to relieve the excess primary air flow into the conduit 36 which is not needed for combustion through conduit 38 but needed for the mill and its conduits; while at high load conditions, it permits some air and coal to flow into the low load system to maintain the burner flame. Still further, the need for complex and expensive external equipment, including separators, fans, structural supports and conduits, are eliminated.

The system and method described herein can be adapted to most existing systems and any new installation since the flow is divided in various parallel paths and additional pressure losses are kept to a minimum.

It is understood that the present invention is not limited to the specific arrangement disclosed above but can be adapted to other configurations as long as the foregoing results are achieved.

For example, the separator-nozzle assembly 40 is not limited to coaxial use within the nozzle 41 but can be placed in an external relationship to the latter nozzle. Also the assembly 40 may be used in furnaces having main fuel injectors located in its four corners for injecting the pulverized coal towards an imaginary circle's circumference, with the circle's center being located along the furnace's center. The system and method of the present invention are also applicable to furnaces which utilize fuel injectors located on a portion of the firing wall which has a horizontal component so that the fuel is injected with a partial down vector, such as, for example, arch-fired furnaces.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A system for combusting coal and air, comprising first nozzle means comprising a cone at least a portion of the wall of which is formed by a plurality of louvers, an inlet for receiving a coal-air mixture and discharging same in an axial direction through said cone to divide said mixture into a first stream containing substantially coal and a second stream containing substantially air, and discharge means for discharging said streams in a combusiton supporting relationship; and second nozzle means extending over said cone for receiving another coal-air mixture and discharging same around said second stream in a combusiton supporting relation to said streams.

2. The apparatus of claim 1 further comprising means for receiving a coal-air mixture from an external source and dividing it into the first-mentioned coal-air mixture and said other coal-air mixture.

3. The apparatus of claim 2 wherein said means for receiving and dividing includes adjustable means for varying the relative quantities of coal and air in said mixtures.

4. The apparatus of claim 1 wherein said discharge means includes two outlets for discharging said first stream and said second stream, respectively.

5. The apparatus of claim 1 wherein said mixture of coal and air passes through said cone with the coal tending to concentrate towards the center of the cone to form said first stream and the air tending to pass between said louvers to form said second stream.

6. The apparatus of claim 1 wherein said first nozzle means further comprises a housing extending over said cone and forming an annular passage therewith, said second stream passing between said louvers and into said annular passage.

7. The apparatus of claim 6 further comprising swirler means disposed at the discharge end of said annular passage for imparting a swirl to said second stream.

8. The apparatus of claim 7 wherein said first stream is discharged from the end of said cone through a venturi section and said second stream is discharged around said first stream.

9. A method of combusting coal and air, comprising the steps of passing a first mixture of coal and air within a louvered wall so that the coal portion of said mixture tends to concentrate within the louvered region and the air portion of said first mixture tends to pass between said louvers, discharging said air portion into an annular passage, imparting a swirl to said air portion as it discharges from said annular passage, discharging said air portion around said coal portion in a combusiton supporting relationship, and discharging a second mixture of coal and air around said air portion in a combustion supporting relation to said coal portion.

10. The method of claim 9 further comprises the step of receiving a coal-air mixture from an external source and dividing it into said first mixture and said second mixture.

11. The method of claim 10 further comprising the step of varying the relative quantities of coal and air in said mixtures.

12. The method of claim 9 wherein said air portion and said coal portion are discharged from separate outlets.

* * * * *